United States Patent [19]

Barnwell et al.

[11] 3,991,394

[45] Nov. 9, 1976

[54] HELICAL INDUCTOR FOR POWER LINES AND THE LIKE

[75] Inventors: Allen M. Barnwell, Lynchburg; Wiley C. Smith, Jr., Rustburg, both of Va.

[73] Assignee: General Electric Company, Lynchburg, Va.

[22] Filed: Dec. 17, 1975

[21] Appl. No.: 641,443

[52] U.S. Cl. ..... 336/60; 336/70; 336/180; 336/186; 336/223

[51] Int. Cl.[2] ..... H01F 15/14; H01F 27/28

[58] Field of Search ..... 336/180, 186, 69, 70, 336/223, 60, 185, 192

[56] References Cited

UNITED STATES PATENTS 580,276 4/1897 Harrington ..... 336/186

2,497,516 2/1950 Phelps ..... 336/186 X

*Primary Examiner*—Thomas J. Kozma

*Attorney, Agent, or Firm*—James J. Williams

[57] ABSTRACT

Current distribution between parallel-connected, coaxial, helical coils is determined by rectangular conductors having a selected radial thickness and longitudinal widths so that each coil carries the desired current. First adjacent ends of all of the coils are connected together at the same physical location by a first common terminal, and second adjacent ends of all of the coils are connected together at the same physical location by a second common terminal. The rectangular conductors facilitate winding and supporting coaxial coils, and different conductor widths and winding pitches permit each coil to be designed so that it has the desired characteristics and importantly so that it carries the desired current.

10 Claims, 3 Drawing Figures

HELICAL INDUCTOR FOR POWER LINES AND THE LIKE

BACKGROUND OF THE INVENTION

Our invention relates to inductors for power lines and the like, and particularly to such inductors having one or more coaxial coils, each of which carries the desired current.

Inductors are frequently connected in series between electrical switch yards or generating equipment and a relatively high voltage electrical power line for various reasons. One reason is to protect the switch yard and generating equipment from voltage surges such as caused by a lightning strike on the power line. Another reason is to provide a high impedance to carrier frequency signals connected to the power line, so that the carrier frequency signals are not transmitted toward the switch yard or generating equipment and thereby attenuated. But as is readily apparent, since such inductors are connected in series with the power lines, they must carry the full current of the power line. Such a current, even when normal, is large (in the order of hundreds of amperes), so that the inductors must have a large number of conductors capable of carrying such currents, and must have a configuration that can handle and disperse the heat resulting from such current.

Accordingly, a general object of our invention is to provide a new and improved helical inductor for use with electrical power lines.

Another object of our invention is to provide a new and improved inductor that can carry relatively large power frequency currents.

In previous helical inductors for connection in series with power lines, the needed current-carrying capability has been provided by a plurality of coaxial coils connected in parallel. Each coil was designed and wound so that the coil carried the desired magnitude of current for the proper dispersion of the heat generated in and by the coil. This was achieved by coils which were wound with transposed conductors. However, transposed conductors are relatively expensive. As a consequence, coils were wound with untransposed conductors with a precise number of full turns plus a fractional part of a turn. While such a coil with untransposed conductors provided the desired current magnitude in each coil, it also created the problem of terminating each concentric coil at the desired angular position that provided the precise number of turns plus the fractional part of a turn. If there were many coaxial coils, this required a mechanical structure that permitted each coil to be terminated at its desired fractional turn location, or required that there be a mechanical structure which had fewer terminal locations and hence a resultant compromise as to the fractional part of a turn. If the fractional turns are terminated on radial arms which extend from a center common terminal, the radial arms are subjected to considerable mechanical stresses caused by an unintended high current surge resulting from a momentary fault or short circuit on the power line.

Accordingly, another object of our invention is to provide a power line inductor that permits all of the coaxial coils to have the desired number of turns, and to terminate at and be connected to a single common terminal at each end, and still have the electrical characteristics that provide the desired current in each coil.

SUMMARY OF THE INVENTION

Briefly, these and other objects are achieved in accordance with our invention by providing a helical inductor having a plurality of coaxial coils. The coaxial coils are formed by rectangular conductors wound side by side in a single layer with a selected number of turns. The conductors of any one coil have the same radial thickness, but have a longitudinal width and pitch so that the coil has the desired electrical characteristics which cause it to carry the desired current magnitude relative to the other coils. Combinations of conductor widths and pitches permit each coil to have the desired number of turns, with the result that all of the coils are terminated at the same location at one end, and all of the coils are terminated at the same location at the other end. This single terminal location at each end provides an improved mechanical structure that permits the inductor to withstand relatively high mechanical stresses.

BRIEF DESCRIPTION OF THE DRAWING

The subject matter which we regard as our invention is particularly pointed out and distinctly claimed in the claims. The structure and operation of our invention, together with further objects and advantages, may be better understood from the following description given in connection with the accompanying drawing, in which:

DESCRIPTION OF A PREFERRED EMBODIMENT

Figure 1:
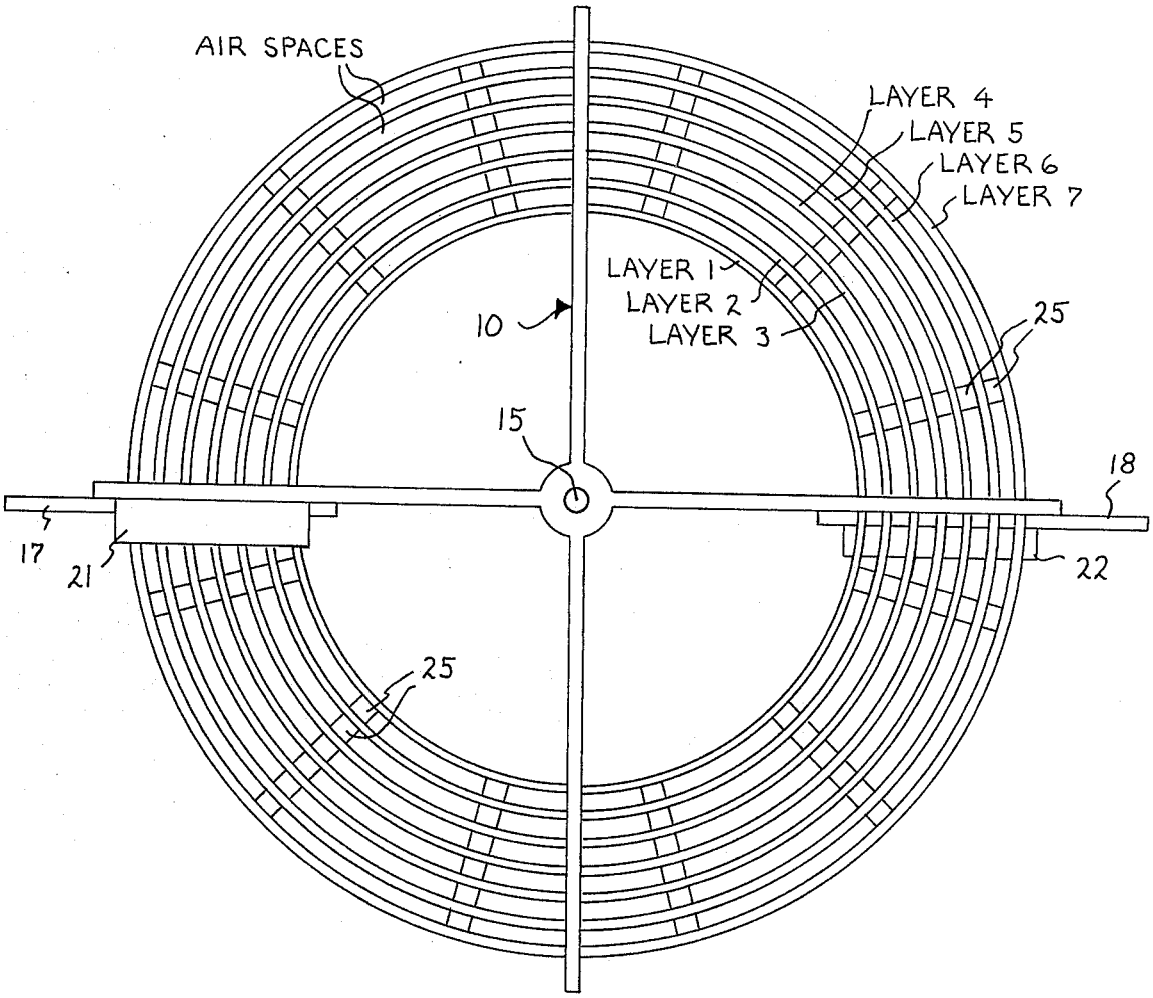
FIG. 1 shows a top plan view of one embodiment of an improved inductor in accordance with our invention.
Figure 2:
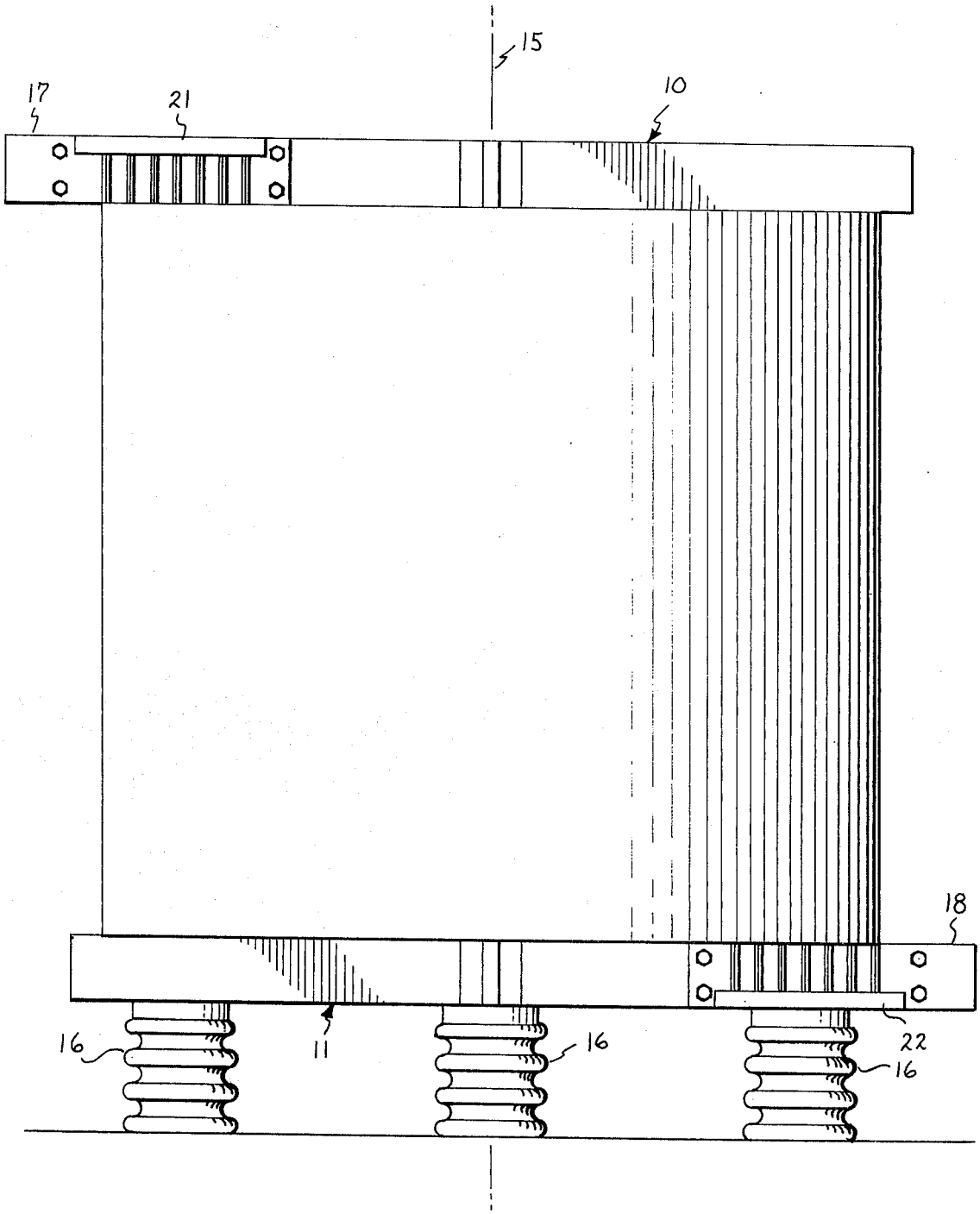
FIG. 2 shows a side elevation view of our inductor of FIG. 1.

With reference to FIGS. 1 and 2, we show top plan and side elevation views respectively of one helical inductor in accordance with our invention. The particular inductor shown is intended to carry a 60 hertz current of 1600 amperes, and have an inductance of approximately 1 millihenry. At each end, we provide our inductor with top and bottom supports 10, 11, each of which comprises four rectangular, metallic, arms which are radially positioned substantially 90° apart. We prefer that the arms of the two supports be respectively located at the same angular position about the longitudinal axis 15 of our inductor. The particular inductor shown is intended to be installed with its longitudinal axis 15 positioned vertically, so that suitable insulators 16 may be positioned under each of the four arms of the bottom support 11. The inductor may also be suspended by an insulator at the top support 10. When such an inductor is installed at a substation, it is convenient for one connection to be made on the substation or switchyard side of the inductor, and for the other connection to be made on the power line side of the inductor. Accordingly, we connect a metallic terminal 17 to the outer end of one arm of the upper support 10, and a metallic terminal 18 on the outer end of a diametrically opposite arm of the bottom support 11 (that is 180 degrees around the axis 15). We also provide a metallic conductor terminating plate 21 on the terminal 17, and a metallic conductor terminating plate 22 on the terminal 18. The supports 10, 11, the terminals 17, 18, and the terminating plates 21, 22 may be fastened in any suitable fashion, such as by bolts or welding, or by both.

In the embodiment shown in FIG. 1, the inductor was designed to have seven layers which are indicated in FIG. 1, and which are numbered 1 through 7 from the inside to the outside. The layers are held together and fastened to the supports by strand material and cement, as will be explained. Each of these seven layers comprises four coils having rectangular conductors. The various layers are separated to provide an air space for cooling. This separation is provided by a suitable number of elongated insulating rods 25 which are spaced around the layers and which extend parallel to the axis 15 for the length of the inductor. Only a few of the rods 25 are given a reference numeral to keep FIG. 1 clear, but all of the rods will be readily recognized.

Figure 3:
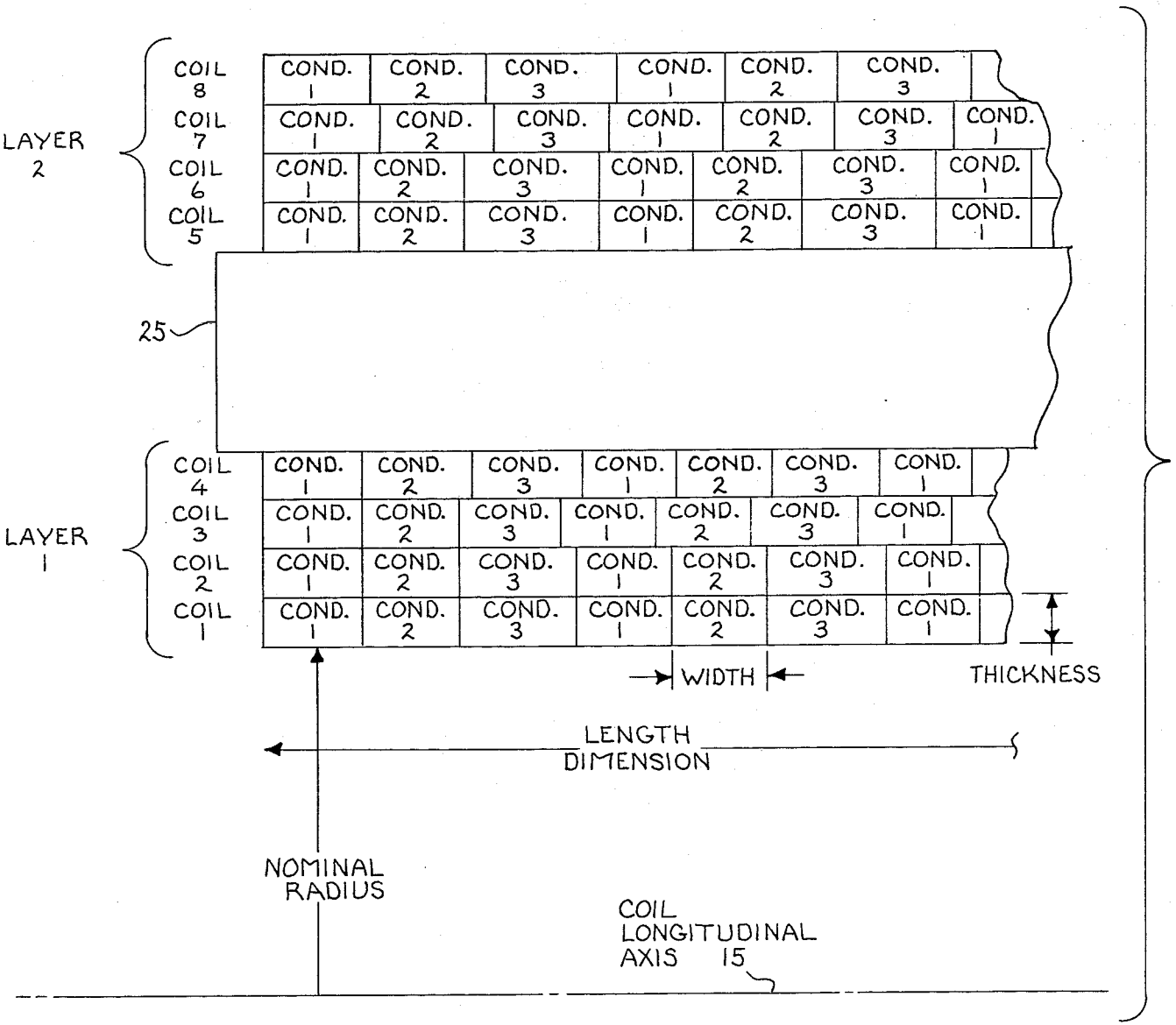
FIG. 3 shows a partial radial cross-section of our inductor of FIGS. 1 and 2.

Further details of the inductor of FIGS. 1 and 2 will be explained in connection with FIG. 3 which shows several turns of the conductors of layers 1 and 2 in cross section. All of the conductors of the inductor are substantially rectangular and have suitable insulation (not shown in the FIGURES), for example a wrapped film or coating of material. However, such insulation need not be excessively thick, since the voltage between adjacent conductors is normally relatively small. The rectangular conductors have selected widths (which we define as the dimension parallel to the longitudinal axis 15) and all conductors preferably have the same thickness (which we define as the dimension along the radius). When the inductor is to be wound, a suitable cylindrical form or mandrel is provided. The supports 10, 11 are positioned at the ends of the mandrel. A base layer of glass ribbon or roving is wrapped on the mandrel and covered with a suitable cement of good strength and insulating quality, such as an epoxy resin. Coil 1 is helically wound on the base layer with its three conductors positioned side by side with the width dimension parallel to the axis 15. The conductors have a selected pitch so that the desired number of turns of the three conductors forming coil 1 are provided between the upper and lower supports 10, 11. After coil 1 of layer 1 is wound, glass roving and cement are applied. The roving and cement are not shown in the FIGURES. Each of the subsequent coils 2, 3, and 4 of layer 1 are wound in similar fashion with the roving and cement so that there are no intentional air spaces between the coils. Coil 4 is also covered with roving and cement. Then, a suitable number of insulating rods 25 are positioned around the completed layer 1, so as to provide an air space and also a support for layer 2, and covered with roving and cement. Then, layer 2 is wound in the same fashion described for layer 1. Thereafter, layers 3 through 7 are wound in a similar fashion. After the coils of a layer are wound, ties of glass roving and cement may be wrapped longitudinally around the support arms for longitudinal strength. This pulls the supports 10 and 11 together and provides a strong, tightly bound inductor. We have not shown the strands, so as to keep the drawings clear. However, we prefer that these strands be positioned longitudinally between the layers and that they be wrapped around respectively positioned arms of the upper and lower supports 10 and 11.

After the seven layers are wound, the inductor with the supports 10, 11 is removed from the mandrel and the end of the conductors near the upper support 10 are bent at right angles (parallel to the axis 15) and connected to the terminating plate 21 at the upper end. In a similar manner, the conductors terminating at the lower support 11 are bent at right angles (parallel to the axis 15) and connected to the terminating plate 22 at the lower end. These connections are preferably made by welding.

The embodiment shown in FIGS. 1, 2, and 3 was constructed with rectangular aluminum conductors wrapped with a plastic film, and had the specifications given in the following table:

Table 1

| Layer No. | Coil No. | Nominal Radius–In. | No. of Conductors and Widths .181″ | .206″ | .219″ | .256″ | No. of Turns | Coil Length-In. |
|---|---|---|---|---|---|---|---|---|
| 1 | 1 | 16.605 | 2 | 0 | 1 | 0 | 56.5 | 33.41 |
| | 2 | 16.711 | 2 | 0 | 1 | 0 | 55.5 | 32.83 |
| | 3 | 16.817 | 2 | 1 | 0 | 0 | 54.5 | 31.52 |
| | 4 | 16.923 | 1 | 2 | 0 | 0 | 54.5 | 32.91 |
| 2 | 5 | 18.014 | 1 | 1 | 0 | 1 | 48.5 | 31.83 |
| | 6 | 18.120 | 1 | 1 | 0 | 1 | 47.5 | 31.19 |
| | 7 | 18.226 | 0 | 0 | 3 | 0 | 47.5 | 31.86 |
| | 8 | 18.332 | 0 | 1 | 1 | 1 | 47.5 | 33.03 |
| 3 | 9 | 19.338 | 0 | 1 | 0 | 2 | 43.5 | 31.95 |
| | 10 | 19.444 | 0 | 0 | 1 | 2 | 43.5 | 32.53 |
| | 11 | 19.550 | 0 | 1 | 0 | 2 | 42.5 | 31.23 |
| | 12 | 19.656 | 0 | 0 | 1 | 2 | 42.5 | 31.80 |
| 4 | 13 | 20.612 | 2 | 2 | 0 | 0 | 40.5 | 32.12 |
| | 14 | 20.718 | 1 | 3 | 0 | 0 | 40.5 | 33.16 |
| | 15 | 20.824 | 0 | 0 | 0 | 3 | 39.5 | 31.0 |
| | 16 | 20.930 | 2 | 2 | 0 | 0 | 39.5 | 31.35 |
| 5 | 17 | 21.861 | 1 | 1 | 2 | 0 | 38.5 | 32.59 |
| | 18 | 21.967 | 0 | 3 | 1 | 0 | 38.5 | 33.06 |
| | 19 | 22.073 | 2 | 1 | 1 | 0 | 37.5 | 30.30 |
| | 20 | 22.179 | 1 | 3 | 0 | 0 | 37.5 | 30.76 |
| 6 | 21 | 23.110 | 0 | 2 | 2 | 0 | 37.5 | 32.73 |
| | 22 | 23.216 | 0 | 1 | 3 | 0 | 37.5 | 33.23 |
| | 23 | 23.332 | 0 | 1 | 3 | 0 | 37.5 | 33.23 |
| | 24 | 23.428 | 0 | 1 | 3 | 0 | 37.5 | 33.23 |
| 7 | 25 | 24.384 | 0 | 1 | 3 | 0 | 37.5 | 33.23 |
| | 26 | 24.490 | 0 | 1 | 3 | 0 | 37.5 | 33.23 |
| | 27 | 24.596 | 0 | 1 | 3 | 0 | 37.5 | 33.23 |
| | 28 | 24.702 | 0 | 1 | 3 | 0 | 37.5 | 33.23 |

As shown by Table 1, the inductor had seven layers. Each layer had four coils and was separated from adjacent layers by an air space of about five-eighths inch radially. This provides a chimney effect and good cooling. The radius of each coil is also shown. Each of the coils was wound with rectangular aluminum conductors selected from four widths, namely 0.181 inch, 0.206 inch, 0.219 inch, and 0.256 inch. These four widths were selected so that pitch increments of 0.013 inch could be obtained. Other widths and increments could also be selected. All of the conductors had the same thickness of approximately 0.106 inch. These dimensions included the wrapped film. The particular number and widths of conductors for each coil were as indicated. Details of layer 1 and layer 2 are shown in the partial cross-section view of FIG. 3. In layer 1, coil 1 was wound with first and second conductors each having widths of 0.181 inch, and a third conductor having a width of 0.219 inch. The three conductors had 56.5 turns and a longitudinal length of 33.41 inches. Coil 2 of layer 1 was similar. In coil 3, the first and second conductors also had the same 0.181 inch width, but the third conductor had a width of 0.206 inch. The illustration of layers 1 and 2 are, we believe, sufficient to show the construction of the entire inductor covered by Table 1. However, we did not show the layers 3 through 7, since it would require that FIG. 3 be too small to illustrate the cross-sections of the conductors. In Table 1, it will be seen that all of the coils have a full integral numbers of turns plus a half of a turn, since the terminals 17, 18 are positioned on diametrically opposite sides of the inductor. After the inductor was constructed, suitable 60 hertz voltage was applied to the terminals 17, 18. The current in each coil was measured, and we found that the currents had values from about 59 amperes in the innermost coil 1, a minimum current of 43 amperes in coil 7 (in layer 2), and a current of about 90 amperes in the outermost coil 28. This current distribution is needed to insure that each layer can dissipate generated heat so as to prevent the layer from reaching a temperature high enough to cause degradation of the insulating and mechanical support system. The total current was approximately 1643 amperes, and the total losses were approximately 8500 watts. This current distribution was relatively good, and the losses were relatively low for an inductor of this size and current carrying capability.

Persons skilled in the art will appreciate the many advantages of our inductor. Some of these advantages are:

1. Our inductor may be wound with a relatively inexpensive aluminum conductor which is light in weight.

2. A large number of design possibilities (and current distributions) can be provided by a relatively small number of conductor widths, for example the four widths shown in Table 1.

3. The ratio of the conductor cross-sectional area to the coil cross-sectional area is improved, since the rectangular conductors are positioned or nested together in much better fashion than the typical round conductors.

4. Electrical insulation is more efficiently used, since it is not necessary that the conductor insulation be used to space the conductors. Spacing is provided by the variable widths and pitches of the conductors.

5. No currents are required to flow in the arms of the supports 10, 11, since all conductors are connected directly to the same single terminating plates 21, 22. Elimination of this current in the support arms is very important in short circuit conditions, since such short circuit currents could apply unusual stresses to the supports.

6. The current distribution is primarily determined by the self and mutual inductance of each coil. While the mutual inductance is somewhat more complicated (the mutual inductance of any coil must be found with every other coil), the following equation for the self inductance $L_S$ of a coil provides an approximation:

$$L_S = \frac{N^2 R^2}{9R + 10\,(NP)}$$

In this equation, R is the radius, N is the number of turns, and P is the winding pitch. In previous coils which required that N include a fractional part of a turn for determining the self inductance, the precision of that determination was limited as a practical matter to about one-eight of a turn. With our inductor wound with four conductors as described, the pitch can be varied by increments of 0.013 inch. Smaller increments are practical. In any case, such relatively small increments of pitch permit the self inductance to be determined more precisely than previously was possible.

While we have shown and described only one embodiment, persons skilled in the art will appreciate the many possibilities that are present in utilizing our rectangular conductors of selected different widths and pitches to provide the desired current distribution and inductance. While Table 1 shows a minimum of three conductors per coil and a maximum of four conductors per coil, we do not intend that our invention be so limited. In fact, as few as one conductor or as many as is practical may be utilized in winding each coil. The number of coils per layer may be as few as one or as many as desired. The number of layers may also be varied as desired. The different available conductor widths may be any increment and number desired. The conductor thicknesses may vary between coils, but we prefer a single thickness for all coils. The number, shape, and size of the support arms may be varied, and the terminals may be on the same side. Our invention is applicable to any of the power frequencies. Therefore, while our invention has been described with reference to only one embodiment, it is to be understood that modifications may be made without departing from the spirit of the invention or from the scope of the claims.

What we claim as new and desire to secure by Letters Patent of the United States is:

1. An improved coil for carrying relatively large currents comprising:

a. a first layer having at least two conductors, each conductor having a substantially rectangular cross section formed by surfaces of selected thickness and width, the thickness of said two conductors being substantially equal and the width of said two conductors being unequal;

b. said two conductors being helically wound in a plurality of turns side by side around a longitudinal axis in supported relation with said width surfaces of said conductors being substantially parallel to said longitudinal axis and with said thickness surfaces of each conductor being spaced a selected distance from the adjacent thickness surface of the adjacent conductor;

c. a first terminal connected to both of said conductors at one end thereof;

d. and a second terminal connected to both of said conductors at the other end thereof.

2. The improved coil of claim 1 wherein said terminals are substantially positioned in a plane that is coincident with said longitudinal axis.

3. An improved helical inductor for use in power lines and the like comprising:

a. a first coil having at least two conductors wound in a plurality of turns about a longitudinal axis side by side in a single layer;

b. each of said two conductors of said first coil having a substantially rectangular cross section formed by parallel width surfaces and by parallel thickness surfaces, the thickness dimensions of said two conductors being substantially equal, and the width dimensions of the first conductor being different from the width dimension of the second conductor;

c. said two conductors of said first coil being positioned so that their outer width surfaces coincide with a line parallel to said longitudinal axis, so that their inner width surfaces coincide with a line parallel to said longitudinal axis, and so that each thickness surface of said first conductor is adjacent to but insulated from the thickness surface of said second conductor;

d. a second coil having at least two conductors wound in a plurality of turns about said longitudinal axis side by side in a single layer, said second coil being around said first coil;

e. each of said two conductors of said second coil having a substantially rectangular cross section formed by parallel width surfaces and by parallel thickness surfaces, the thickness dimensions of said two conductors being substantially equal, and the width dimensions of the first conductor being different from the width dimension of the second conductor;

f. said two conductors of said second coil being positioned so that their outer width surfaces coincide with a line parallel to said longitudinal axis, so that their inner width surfaces coincide with a line parallel to said longitudinal axis, and so that each thickness surface of said first conductor is adjacent to but insulated from the thickness surface of said second conductor;

g. a first terminal connected to all of said conductors of said coils at a common location at one end of said conductors;

h. and a second terminal connected to all of said conductors of said coils at a common location at the other end of said conductors.

4. The improved inductor of claim 3 wherein said first and second terminals are positioned on opposite sides of said longitudinal axis.

5. The improved inductor of claim 3 wherein each of said coils is cylindrical and coaxial relative to the other of said coils.

6. The improved inductor of claim 5 wherein said first and second terminals are positioned on opposite sides of said longitudinal axis.

7. An improved helical inductor for carrying relatively high current comprising:

a. a first cylindrical coil coaxially wound about a longitudinal axis;

b. said first coil comprising at least two rectangular, metallic conductors positioned side by side, said two conductors having different longitudinal widths and having a selected spacing between turns;

c. first and second terminals respectively positioned at each end of said first coil, said terminals being located on opposite sides of said longitudinal axis substantially in a plane that passes through said longitudinal axis;

d. means terminating adjacent first ends of said conductors at said first terminal and connecting said first end of said conductors to said first terminal;

e. and means terminating adjacent second ends of said conductors at said second terminal, and connecting said second ends of said conductors to said second terminal.

8. The improved inductor of claim 7 and further comprising:

a. a second cylindrical coil coaxially wound about said longitudinal axis;

b. said second coil comprising at least two rectangular, metallic conductors positioned side by side, said two conductors of said second coil having different longitudinal widths and having a selected spacing between turns;

c. means terminating adjacent first ends of said conductors of said second coil at said first terminal, and connecting said first ends of said conductors to said first terminal;

d. and means terminating adjacent second ends of said conductors of said second coil at said second terminal, and connecting said second ends of said conductors to said second terminal.

9. The improved inductor of claim 8 wherein said second coil is wound on but insulated from said first coil.

10. The improved inductor of claim 8 wherein said second coil is wound about but spaced from said first coil by an air space.

* * * * *